US006699922B2

(12) United States Patent
Birnbrich et al.

(10) Patent No.: US 6,699,922 B2
(45) Date of Patent: Mar. 2, 2004

(54) HYDROPHILIC ADDITIVE

(75) Inventors: Paul Birnbrich, Solingen (DE); Raymond Mathis, Duesseldorf (DE); Christine Wild, Hilden (DE); Petra Padurschel, Grevenbroich (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 248 days.

(21) Appl. No.: 09/782,366

(22) Filed: Feb. 13, 2001

(65) Prior Publication Data

US 2002/0019184 A1 Feb. 14, 2002

(30) Foreign Application Priority Data

Mar. 30, 2000 (DE) ..... 100 15 554

(51) Int. Cl.[7] ..... C08J 3/00; C08K 5/09; C08K 5/10; C08L 23/06; D01F 1/02

(52) U.S. Cl. ..... 524/284; 264/211.22; 264/211; 442/59; 442/118; 442/327

(58) Field of Search ..... 442/327, 59, 118; 524/284; 264/211.22, 211

(56) References Cited

U.S. PATENT DOCUMENTS 3,855,046 A 12/1974 Hansen et al.
5,439,734 A 8/1995 Everhart et al.

FOREIGN PATENT DOCUMENTS

WO WO 95/10648 4/1995

OTHER PUBLICATIONS

Ullmann's Encyclopedia of Industrial Chemistry, 5th Edition, vol. A 17, VCH Weinheim (1994), pp. 572–581.

*Primary Examiner*—Patrick D. Niland
(74) *Attorney, Agent, or Firm*—John E. Drach; Steven J. Trzaska

(57) ABSTRACT

Polymers having increased hydrophilicity are made by adding to the polymer an effective amount of an additive which is a di-$C_{10-12}$ fatty acid ester of polyethylene glycol.

31 Claims, No Drawings

HYDROPHILIC ADDITIVE

CROSS-REFERENCE TO RELATED APPLICATIONS

This application claims priority of German patent application number 100 155 54.5, filed on Mar. 30, 2000.

STATEMENT REGARDING FEDERALLY SPONSORED RESEARCH AND DEVELOPMENT

Not Applicable.

BACKGROUND OF THE INVENTION

For many applications, the surface of polymeric articles of manufacture must possess specific properties such as the improved wettability with polar liquids such as water; this would be useful for the manufacture of personal hygiene articles, for example.

Personal hygiene articles, such as diapers or sanitary napkins, are manufactured using materials capable of absorbing aqueous fluids. To prevent direct contact with the absorbent material in use and to increase the wear comfort, this material is sheathed with a thin, water-pervious non-woven fabric. Such nonwovens are customarily produced from synthetic fibers, such as polyolefin or polyester fibers, since these fibers are inexpensive to produce, have good mechanical properties and possess heat resistance. However, untreated polyolefin or polyester fibers are unsuitable for this purpose, since their hydrophobic surface makes them insufficiently pervious to aqueous fluids.

It is in principle possible to impart the requisite hydrophilic properties to fibers by coating the fibers with appropriate spin finishes or by including suitable additives in the polymer material from which the fibers are produced. The latter is described in U.S. Pat. No. 5,439,734, which discloses diesters of polyethylene glycol with fatty acids having up to 18 carbon atoms or derivatives thereof as suitable durable additives.

SUMMARY OF THE INVENTION

The present invention provides for the use of di-$C_{10-12}$ fatty acid esters of polyethylene glycol which can be made by reacting one mole of polyethylene glycol with 2 moles of a fatty acid having 10 to 12 carbon atoms or derivatives thereof. These esters function as additives for the permanent hydrophilicization of polyolefinic materials.

It has now been found that, surprisingly, selected diesters of polyethylene glycols have better properties with regard to the hydrophilic finishing of polymeric materials than the compounds disclosed in U.S. Pat. No. 5,439,734.

Accordingly, one aspect of the invention relates to a process for increasing the hydrophilicity of a polymer comprising adding to the polymer an effective amount of a di-$C_{10-12}$ fatty acid ester of polyethylene glycol.

Another aspect of the invention relates to a process for making a synthetic fiber having increased hydrophilicity comprising the steps of: (1) adding an effective amount of a di-$C_{10-12}$ fatty acid ester of polyethylene glycol to a polymer to form a mixture; (2) heating the mixture to form a melt; and (3) spinning the melt into a fiber.

Yet another aspect of the invention relates to a non-woven fabric having increased hydrophilicity which comprises synthetic fibers comprised of a polymer containing an effective amount of a di-$C_{10-12}$ fatty acid ester of polyethylene glycol.

BRIEF DESCRIPTION OF THE SEVERAL VIEWS OF THE DRAWINGS

Not Applicable

DETAILED DESCRIPTION OF THE INVENTION

The term additive as used herein means di-$C_{10-12}$ fatty acid esters of polyethylene. These additives can be added to or incorporated into polymeric materials which are subsequently made into fibers, fabrics, such as nonwovens, films and foams having permanent hydrophilicization because of the presence of one or more of the additives. The additives according to the invention can be added to any type of polymeric material that can be formed into fibers. Such fibers are commonly known as synthetic fibers because they are made from synthetic polymers. These polymers include, but are not limited to, all types of polyolefins such as homopolymers and copolymers of ethylene or propylene and blends of polyolefins with copolymers such as, for example, poly(ethylene) such as HDPE (high density polyethylene), LDPE (low density polyethylene), VLDPE (very low density polyethylene), LLDPE (linear low density polyethylene), MDPE (medium density polyethylene), UHMPE (ultra high molecular polyethylene), CPE (crosslinked polyethylene), HPPE (high pressure polyethylene); poly(propylene) such as isotactic polypropylene; syndiotactic polypropylene; metallocene propylene, impact-modified polypropylene, random copolymers based on ethylene and propylene, block copolymers based on ethylene and propylene; EPM (poly[ethylene-co-propylene]); EPDM (poly[ethylene-co-propylene-co-conjugated diene]); poly(styrene); poly(methylstyrene); poly(oxymethylene); metallocene-catalysed alpha-olefin or cycloolefin copolymers such as norbornene-ethylene copolymers; copolymers containing not less than 60% of ethylene and/or styrene and not more than 40% of monomers such as vinyl acetate, acrylic esters, methacrylic esters, acrylic acid, acrylonitrile, vinyl chloride. Examples of such polymers are: poly(ethylene-co-ethyl acrylate), poly (ethylene-co-vinyl acetate), poly(ethylene-co-vinyl chloride), poly(styrene-co-acrylonitrile); graft copolymers and also polyblends, i.e. blends of polymers including, inter alia, the aforementioned polymers, for example polyblends based on polyethylene and polypropylene.

While all types of polyolefins are preferred polymers according to the invention, homo- and copolymers based on ethylene and propylene are particularly preferred. One embodiment of the present invention accordingly comprises using polyethylene only as the polyolefin, while another embodiment utilizes polypropylene exclusively and yet another embodiment copolymers based on ethylene and propylene.

The additives according to the invention are diesters of polyethylene glycol, also known as polyoxyethylene, wherein the acid moiety of the esters is a saturated or unsaturated, including polyunsaturated, aliphatic moiety having from 10 to 12 carbon atoms. Examples of such acids include, but are not limited to, decanoic acid or capric acid, undecanoic acid or undecylic acid, dodecanoic acid or lauric acid, 4-decenoic acid or obtusilic acid, 9-decenoic acid or caproleic acid, 11-undecenoic acid or undecylenic acid, 3-dodenoic acid or linderic acid, and the like. The di-$C_{10-12}$ fatty acid esters of polyethylene glycol according to the invention can be made by reacting polyethylene glycols, preferably having a molecular weight of 300 to 600 and more preferably those having a molecular weight of 400, with fatty acids having 10 to 12 carbon atoms or derivatives thereof in a conventional manner, preferably in the presence of catalysts.

In a very particularly preferred embodiment of the invention, the additives are used in polypropylene fibers and are comprised of saturated fatty acids having 10 to 12 carbon atoms. Methyl esters of C10 to C12 fatty acids are preferred as fatty acid derivatives. The alcohol component and the acid component are reacted in a molar ratio of about 1:2. Particularly preferred esters are the di-decanoate and di-laurate esters of polyethylene glycol having a molecular weight of 400 and mixtures of such esters. It is also possible to react mixtures of the acids with the polyethylene glycol.

The amount of additive that can be used in the processes and compositions according to the invention is an effective amount which is any amount required to bring about a desired degree of hydrophilicity of a particular polymer. The effective amount will typically depend upon the desired degree of hydrophilicity, the polymer and the additive itself and will be readily determinable by one of ordinary skill in the art. Typically, the amount of the additive required to increase the hydrophilicity of a polymer will be from about 0.5% to about 10% by weight of the polymer, preferably the amount will be from about 0.5% to about 5% by weight and most preferably from about 1.0% to about 2.5% by weight.

The invention further provides a process for producing hydrophilicized polypropylene fibers, wherein polyolefins are mixed with the additives, this mixture is then heated to form a melt and the melt is spun into fibers in a conventional manner. Processes for spinning are known to one skilled in the art and are described for example in U.S. Pat. No. 5,439,734 or in U.S. Pat. No. 3,855,046.

The invention further provides for the use of the hydrophilicized polyolefin-based fibers prepared by the above-described process and wettable by aqueous media for producing textile fabrics. The textile fabrics are preferably nonwoven fabrics. In a particularly preferred embodiment, these textile fabrics are intended for use in diapers. For the last-mentioned case, the use of textile fabrics in diapers, the individual wetting test constitutes a suitable simulation. This is because diapers are typically worn for a period of 3 to 5 hours, in the course of which their inner surface is on average wetted up to 3 times with urine. It then has to be ensured that a hydrophilicized nonwoven based on an otherwise hydrophobic polymer is on each occasion sufficiently wettable so that the urine may pass through the nonwoven and may be immobilized by the absorbent material in the diaper.

Nonwoven fabrics can be produced according to all prior art processes of web production as described for example in Ullmann's Encyclopedia of Industrial Chemistry, Vol. A 17, VCH Weinheim 1994, pages 572–581. Preference is given to webs produced either by the dry laid or the spunbond process. The dry laid process starts with staple fibers which are customarily separated into individual fibers by carding and then laid together, aerodynamically or hydrodynamically, to form the unconsolidated web material. This is then bonded, for example thermally, to form the finished nonwoven fabric. In thermal bonding, the synthetic fibers are either heated to such an extent that their surface melts and the individual fibers become bonded together at the points of contact, or the fibers are coated with an additive which melts on heating and so bonds the individual fibers together. The bond is fixed by cooling. As well as this process, it will be appreciated, all other processes that are used in the prior art for bonding nonwovens are suitable. Spunbond production, in contrast, starts from individual filaments, which are melt spun from extruded polymers which are forced through spinnerettes under high pressure. The filaments emerging from the spinnerettes are bundled, drawn and laid down to form a web, which is customarily consolidated by thermal bonding.

Examples 1 and 2 below describe the preparation of di-$C_{10}$ and $C_{12}$ fatty acid esters of polyethylene glycol which are additives according to the invention. The comparative examples describe the preparation of additives outside of the invention.

EXAMPLE 1

Preparation of a polyethylene glycol 400 dilaurate 139 g (0.35 mol) of polyethylene glycol 400 are admixed with 149.75 g (0.7 mol) of methyl laurate in the presence of 1.45 g of Svedcat 5 (Sn-organic catalyst from Svedstab) The reaction mixture is heated to 100° C. under nitrogen. The methanol formed is gradually distilled off by raising the bath temperature up to 180° C. Once the separation of methanol has ceased, the pressure is reduced to 5 mbar and remaining methanol is distilled off at 180° C. over 45 minutes. The reaction ends when methanol is no longer separated. OH number: 20 mg of KOH/g.

EXAMPLE 2

Preparation of a polyethylene glycol 400 didecanoate 180 g of polyethylene glycol 400 are admixed with 155.6 g of decanoic acid in the presence of 1.68 g of Svedcat 3 (Sn-organic catalyst from Svedstab).The reaction mixture is heated to 100° C. under nitrogen. The water formed is gradually distilled off by raising the bath temperature up to 180° C. Once the separation of water has ceased, the pressure is reduced to 5 mbar and remaining water is distilled off at 180° C. over 45 minutes. The reaction ends when water is no longer separated. OH number: 12 mg of KOH/g, acid number: 8.7 g of KOH/g.

COMPARATIVE EXAMPLE-C1

122.3 g of polyethylene glycol 400 are admixed with 177.9 g of methyl oleate in the presence of 1.88 g of Svedcat 5 (Sn-organic catalyst from Svedstab). The reaction mixture is heated to 100° C. under nitrogen. The methanol formed is gradually distilled off by raising the bath temperature up to 180° C. Once the separation of methanol has ceased, the pressure is reduced to 5 mbar and remaining methanol is distilled off at 180° C. over 45 minutes. The reaction ends when methanol is no longer separated. OH number: 9.3 mg of KOH/g.

COMPARATIVE EXAMPLE-C2

Preparation of a polyethylene glycol 400 dipalmitate 140.7 g of polyethylene glycol 400 are admixed with 189.8 g of methyl palmitate in the presence of 1.65 g of Svedcat 5 (Sn-organic catalyst from Svedstab). The reaction mixture is heated to 100° C. under nitrogen. The methanol formed is gradually distilled off by raising the bath temperature up to 180° C. Once the separation of methanol has ceased, the pressure is reduced to 5 mbar and remaining methanol is distilled off at 180° C. over 45 minutes. The reaction ends when methanol is no longer separated. OH number: 20 mg of KOH/g.

Polypropylene specimens incorporating different test substances (A and B=inventive examples; C1 to C2=comparative examples) were subjected to a wetting test which is carried out as follows:

1. 600 g of a high molecular weight polypropylene pellet ("Eltex PHY 671" from Solvay) are mixed with 9.0 g (=1.5% by weight) of the substance to be tested with regard to a hydrophilic finish. This mixture is funnelled into an extruder (DSK 42/7 twin screw extruder from Brabender OHG/Duisburg). An extruder, as will be known, is a processing machine useful for continuously mixing and plasticating thermoplastics both in powder and in pellet form. Underneath the feed funnel is a water cooling system, to prevent premature melting of the pellets or powder, and a contrarotating twin screw which is lengthwise divided into three heating zones. The temperature of the heating zones and the speed of rotation of the twin screw can be controlled via a Plast Corder PL 2000 unit, which is connected to the extruder via a PC interface. Heating zones I, II and III are each set to a temperature of 200° C., the three heating zones being air cooled to keep the temperature constant. The mixture of polypropylene pellets and test substance is automatically drawn into the extruder by the contrarotating twin screw and conveyed along the screw. The speed is set to 25 revolutions per minute to ensure good mixing and homogenization. This homogeneous mixture finally passes into a die which constitutes a fourth heating zone. The temperature of this die is set to 200° C.; so that this is the temperature at which the mixture leaves the extruder. The die is chosen so that the average diameter of the strand following exit from this die is in the region of about 2–3 mm. This strand is cut into pellets about 2–4 mm in length. The pellets obtained are cooled to 20° C. These pellets are processed on a melt spinning range at 280° C. (i.e. both the melt star temperature and the temperature of the spinnerette are adjusted to 280° C.) gravimetrically, (i.e. by the action of the force of gravity) to form fibers. The fibers obtained have a linear density in the range of about 10–30 dtex (1 dtex corresponds to 1 g of fiber per 10,000 m of fiber length). 500 m of this fiber are then wound onto a reel 6.4 cm in diameter. This fiber on a reel is unwound and the unwound circular structure is stabilized by knotting in the centre to obtain a structure having the shape of a FIG. 8; this structure is subsequently referred to as a skein.

2. A graduated 1 L cylinder (glass cylinder 6.0 cm in internal diameter) is filled with distilled water at 20° C. to the 1000 ml mark. The skein to be tested is held in such a way that its longitudinal direction coincides with the vertical of the graduated cylinder, i.e. that the skein appears as a vertical FIG. 8. The bottommost part of this 8 then has attached to it a weight which consists of copper wire, the mass of the copper wire being 0.2064 g of copper per gram of skein. This copper wire is attached to the skein in the form of coils, the diameter of the copper wire coils being about 1 to 2 cm; these copper wire coils are then pressed together by applying light pressure between thumb and index finger. The skein with the copper weight is then held above the water surface in the graduated cylinder in such a way that the lower part of the copper weight dips into the water and the bottommost part of the skein is situated about 2 mm above the water surface. The skein is then released and the time which a skein needs to dip completely into the water including its upper edge (complete immersion time) is measured with a stopwatch in seconds. The start and the end of the time taken are defined by the bottommost end of the skein passing the 1000 ml mark and the upper end of the skein likewise the 1000 ml mark. This first measured value is referred to as the C1 value ("value of the first wetting cycle").

3. After the C1 value has been determined, the skein is immediately removed from the graduated cylinder, dabbed with cellulose and dried for 1 hour at 40° C. in a through-circulation drying cabinet (of the type UT 5042 EK from Heraeus). Step 2 is then repeated. The value now obtained for the complete immersion time in seconds is referred to as the C2 value ("value of the second wetting cycle"). Drying and determination of the complete immersion time are again repeated to obtain the C3 value ("value of the third wetting cycle"). If the complete immersion time (C1 to C3 values) is above 180 seconds, the respective cycle is terminated.

The wetting test is deemed to have been passed when C1 to C3 are below 5 seconds.

The test results are reported in Table 1 in terms of the complete immersion times (in seconds).

| | Additive (1.5% by weight in each case) in PP fibre (Eltex PHY 677) | C1 [sec] (after spinning) | C2 [sec] (24 h after C 1, drying at RT) | C3 [sec] (24 h after C 2, drying at RT) |
|---|---|---|---|---|
| A | PEG 400 dilaurate | 1.1 | 1.6 | 1.5 |
| B | PEG 400 didecanoate | 1.5 | 2.4 | 2.5 |
| C1 | PEG 400 dioleate | >180 | >180 | >180 |
| C2 | PEG 400 dipalmitate | 6.5 | 6.6 | 50.2 |

What is claimed is:

1. A process for increasing the hydrophilicity of a polymer comprising adding to the polymer an effective amount of a di-$C_{10-12}$ fatty acid ester of polyethylene glycol.

2. The process of claim 1 wherein the polyethylene glycol has a molecular weight of from about 300 to about 600.

3. The process of claim 2 wherein the polyethylene glycol has a molecular weight of about 400.

4. The process of claim 1 wherein the effective amount is from about 0.5% to about 10% by weight of the polymer.

5. The process of claim 4 wherein the effective amount is from about 0.5% to about 5% by weight of the polymer.

6. The process of claim 5 wherein the effective amount is from about 1.0% to about 2.5% by weight of the polymer.

7. The process of claim 1 wherein the ester is di-laurate ester of polyethylene glycol.

8. The process of claim 7 wherein the polyethylene glycol has a molecular weight of about 400.

9. The process of claim 1 wherein the ester is di-decanoate ester of polyethylene glycol.

10. A process for making a synthetic polypropylene fiber having increased hydrophilicity comprising the steps of: (1) adding an effective amount of a di-$C_{10-12}$ fatty acid ester of polyethylene glycol to polypropylene to form a mixture; (2) heating the mixture to form a melt; and (3) spinning the melt into a fiber.

11. The process of claim 10 wherein the polyethylene glycol has a molecular weight of from about 300 to about 600.

12. The process of claim 11 wherein the polyethylene glycol has a molecular weight of about 400.

13. The process of claim 10 wherein the effective amount is from about 0.5% to about 10% by weight of the polymer.

14. The process of claim 13 wherein the effective amount is from about 0.5% to about 5% by weight of the polymer.

15. The process of claim 14 wherein the effective amount is from about 1.0% to about 2.5% by weight of the polymer.

16. The process of claim 10 wherein the ester is di-laurate ester of polyethylene glycol.

17. The process of claim 16 wherein the polyethylene glycol has a molecular weight of about 400.

18. The process of claim 10 wherein the ester is di-decanoate ester of polyethylene glycol.

19. The process of claim 18 wherein the polyethylene glycol has a molecular weight of about 400.

20. A non-woven fabric having increased hydrophilicity which comprises synthetic fibers comprised of a polymer containing an effective amount of a di-$C_{10-12}$ fatty acid ester of polyethylene glycol.

21. The non-woven fabric of claim 20 wherein the polyethylene glycol has a molecular weight of from about 300 to about 600.

22. The non-woven fabric of claim 21 wherein the polyethylene glycol has a molecular weight of about 400.

23. The non-woven fabric of claim 20 wherein the effective amount is from about 0.5% to about 10% by weight of the polymer.

24. The non-woven fabric of claim 23 wherein the effective amount is from about 0.5% to about 5% by weight of the polymer.

25. The non-woven fabric of claim 24 wherein the effective amount is from about 1.0% to about 2.5% by weight of the polymer.

26. The non-woven fabric of claim 20 wherein the ester is di-laurate ester of polyethylene glycol.

27. The non-woven fabric of claim 26 wherein the polyethylene glycol has a molecular weight of about 400.

28. The non-woven fabric of claim 20 wherein the ester is di-decanoate ester of polyethylene glycol.

29. The non-woven fabric of claim 28 wherein the polyethylene glycol has a molecular weight of about 400.

30. The non-woven fabric of claim 20 wherein the polymer is polyethylene.

31. The non-woven fabric of claim 20 wherein the polymer is polypropylene.

* * * * *